US009162864B1

(12) United States Patent
Wickramasinghe

(10) Patent No.: US 9,162,864 B1
(45) Date of Patent: Oct. 20, 2015

(54) BEVERAGE TRAY FILLING ASSEMBLY

(76) Inventor: Saliya A. Wickramasinghe, Sun Valley, CA (US)

( * ) Notice: Subject to any disclaimer, the term of this patent is extended or adjusted under 35 U.S.C. 154(b) by 464 days.

(21) Appl. No.: 13/563,878

(22) Filed: Aug. 1, 2012

(51) Int. Cl.
*B67D 3/00* (2006.01)
*B01F 13/10* (2006.01)
*A47G 33/00* (2006.01)

(52) U.S. Cl.
CPC ..... *B67D 3/0029* (2013.01); *A47G 33/002* (2013.01); *B01F 13/1058* (2013.01)

(58) Field of Classification Search
CPC .... B01F 13/1058; B67D 3/00; B67D 3/0029; A47G 33/00; A47G 33/02; A47G 33/002
USPC ..... 141/2, 144, 234–248, 256, 267–268, 141/283; 222/144, 144.5
See application file for complete search history.

(56) References Cited

U.S. PATENT DOCUMENTS

| | | | | | |
|---|---|---|---|---|---|
| 1,416,126 | A | | 5/1922 | Rainey | |
| 1,709,771 | A | * | 4/1929 | Brady | 141/242 |
| 2,541,787 | A | * | 2/1951 | Stewart | 312/97.1 |
| 3,196,909 | A | * | 7/1965 | Monk | 141/237 |
| 3,893,494 | A | | 7/1975 | Whitney | |
| 4,415,011 | A | * | 11/1983 | Grant | 141/284 |
| 4,453,576 | A | * | 6/1984 | Burns | 141/168 |
| 4,887,651 | A | | 12/1989 | Santiago | |
| 5,092,378 | A | | 3/1992 | Dunham | |
| D344,872 | S | | 3/1994 | Velez | |
| 5,911,253 | A | * | 6/1999 | Webb | 141/243 |
| 6,158,484 | A | * | 12/2000 | Greenlee | 141/242 |
| 6,170,386 | B1 | * | 1/2001 | Paul | 99/281 |
| 6,601,619 | B1 | * | 8/2003 | Greenlee | 141/243 |
| 8,167,006 | B1 | * | 5/2012 | Mathis et al. | 141/247 |
| 8,230,774 | B1 | * | 7/2012 | Hunte | 99/289 R |
| 8,640,748 | B2 | * | 2/2014 | Chera | 141/243 |
| 2011/0209625 | A1 | * | 9/2011 | Kang | 99/323.3 |

* cited by examiner

*Primary Examiner* — Kevin P Shaver
*Assistant Examiner* — Andrew StClair

(57) ABSTRACT

A beverage tray filling assembly includes a housing having a bottom and a perimeter wall extending upwardly from the bottom of the housing. The perimeter wall defines a base of the housing. An access opening extends through the perimeter wall of the housing. A tank is coupled to the housing and configured for holding a beverage. A filling assembly is coupled to and positioned in the housing. The filling assembly is in fluid communication with the tank whereby the filling assembly dispenses the beverage from the tank. A tray is insertable through the access opening and positionable in the base of the housing. Each of a plurality of serving cups is positioned in an associated aperture in the tray. The tray is positionable such that each serving cup receives the beverage dispensed from the tank by the filling assembly.

9 Claims, 7 Drawing Sheets

BEVERAGE TRAY FILLING ASSEMBLY

BACKGROUND OF THE DISCLOSURE

Field of the Disclosure

The disclosure relates to beverage dispensers and more particularly pertains to a new beverage dispenser for filling individual cups held in a tray to facilitate preparation for a communion ceremony.

SUMMARY OF THE DISCLOSURE

An embodiment of the disclosure meets the needs presented above by generally comprising a housing having a bottom and a perimeter wall extending upwardly from the bottom of the housing. The perimeter wall defines a base of the housing. An access opening extends through the perimeter wall of the housing. A tank is coupled to the housing and configured for holding a beverage. A filling assembly is coupled to and positioned in the housing. The filling assembly is in fluid communication with the tank whereby the filling assembly dispenses the beverage from the tank. A tray is insertable through the access opening and positionable in the base of the housing. Each of a plurality of serving cups is positioned in an associated aperture in the tray. The tray is positionable such that each serving cup receives the beverage dispensed from the tank by the filling assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
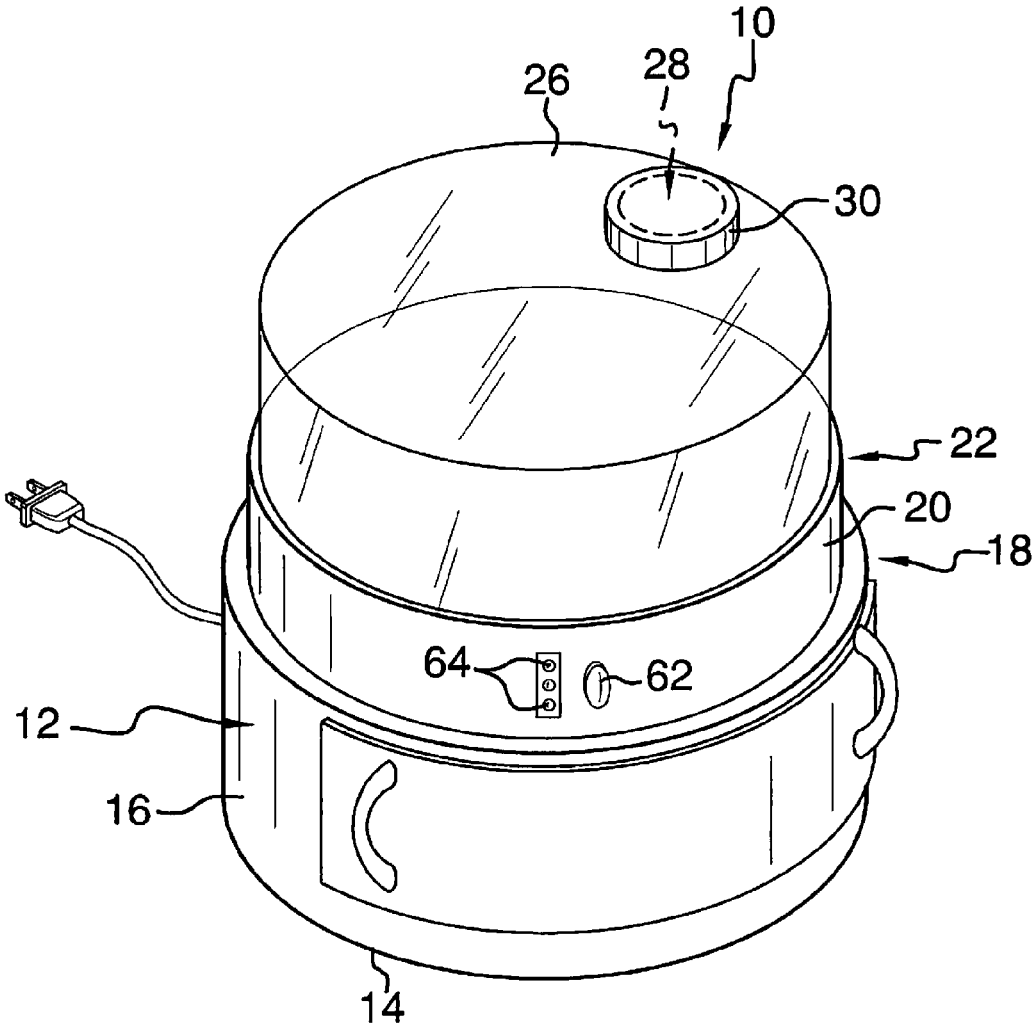
FIG. 1 is a top front side perspective view of a beverage tray filling assembly according to an embodiment of the disclosure.

With reference now to the drawings, and in particular to FIGS. 1 through 10 thereof, a new beverage dispenser embodying the principles and concepts of an embodiment of the disclosure and generally designated by the reference numeral 10 will be described.

Figure 2:
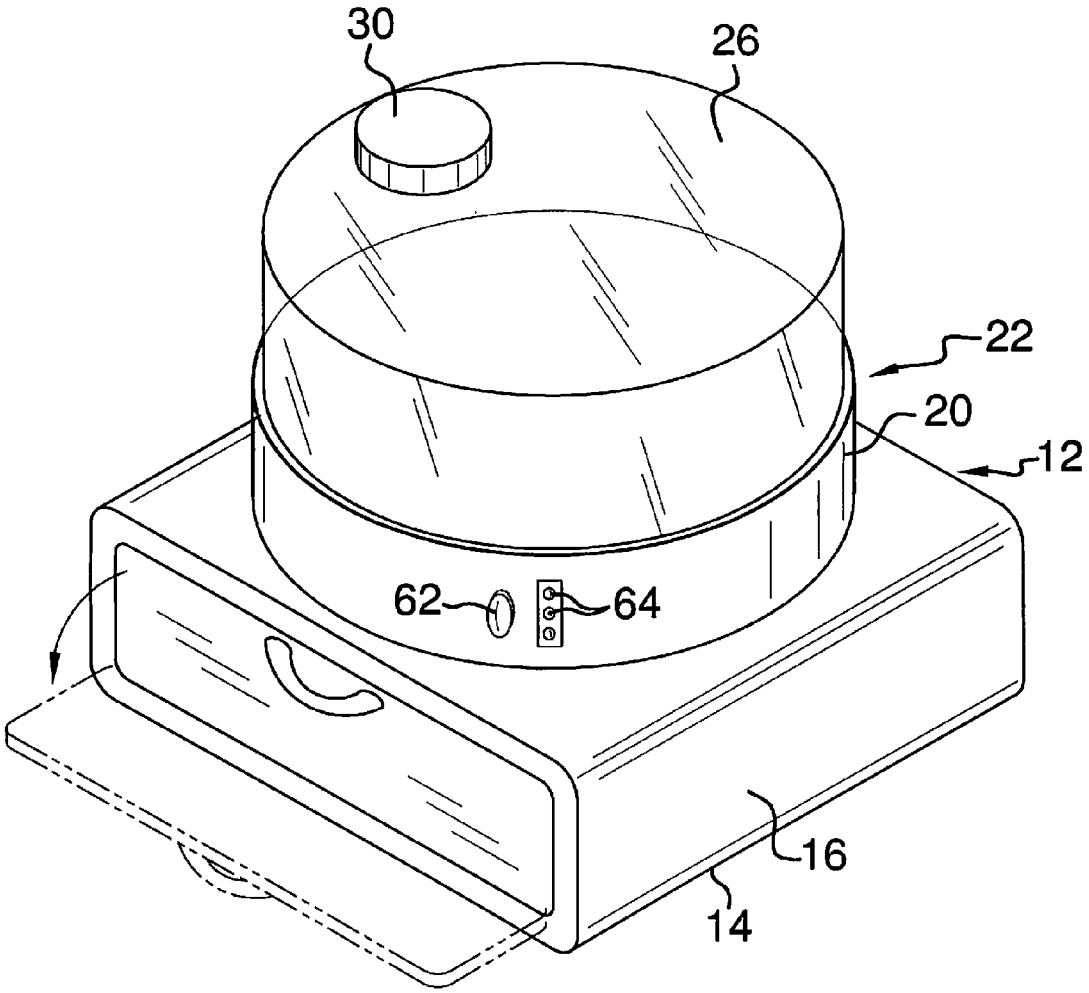
FIG. 2 is a top front side perspective view of an embodiment of the disclosure.
Figure 3:
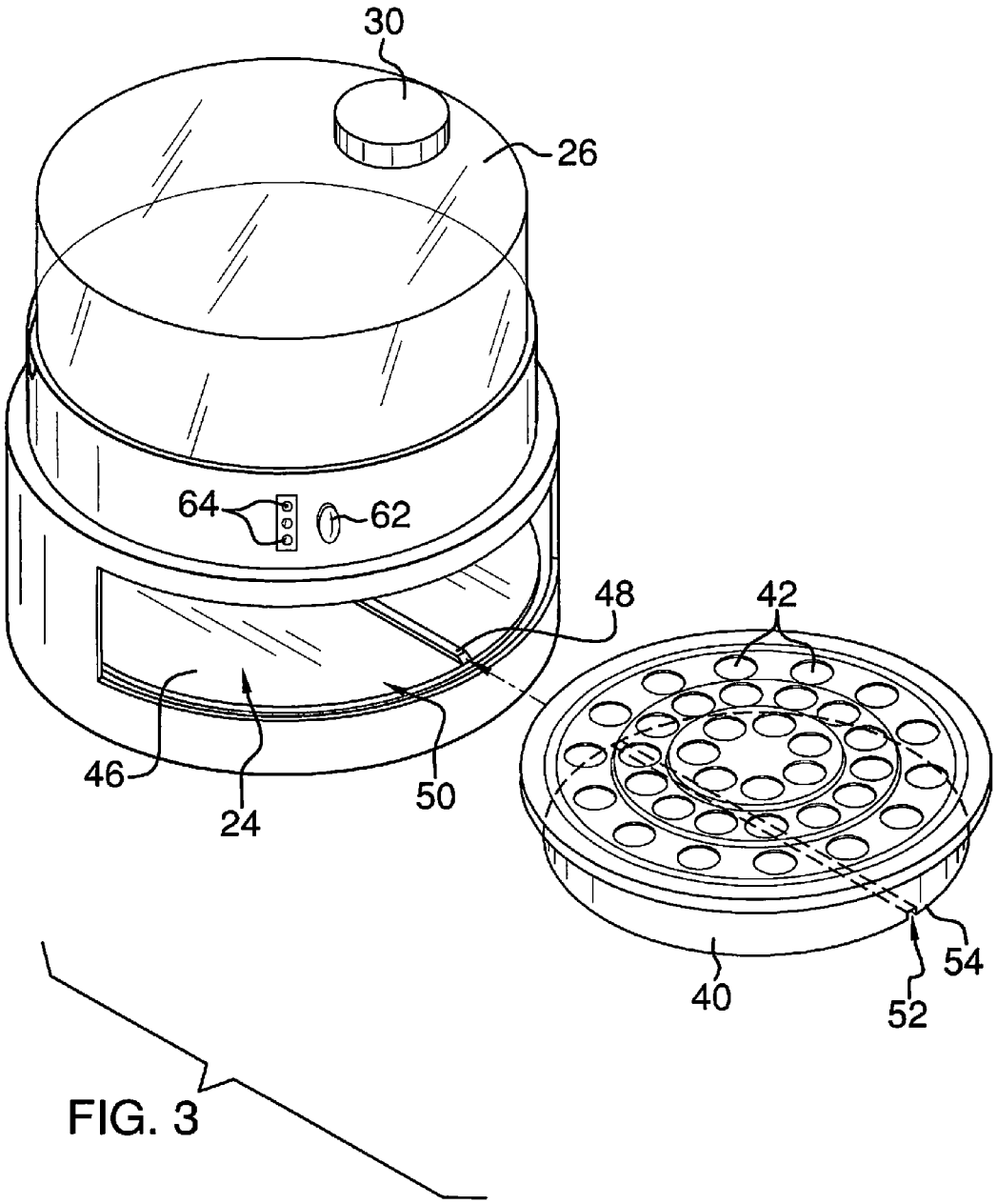
FIG. 3 is a partially exploded top front side perspective view of an embodiment of the disclosure.
Figure 4:
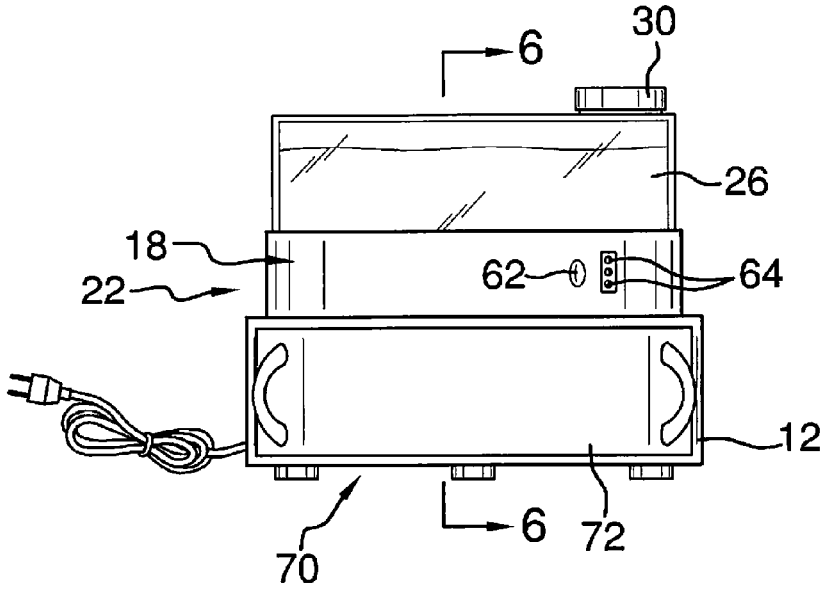
FIG. 4 is a front view of an embodiment of the disclosure.
Figure 5:
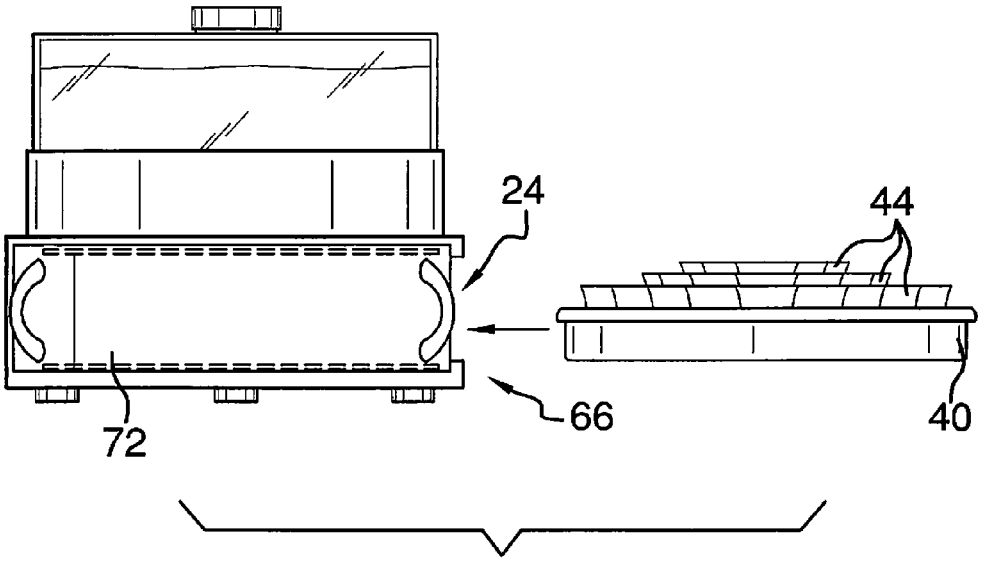
FIG. 5 is a partially exploded side view of an embodiment of the disclosure.
Figure 6:
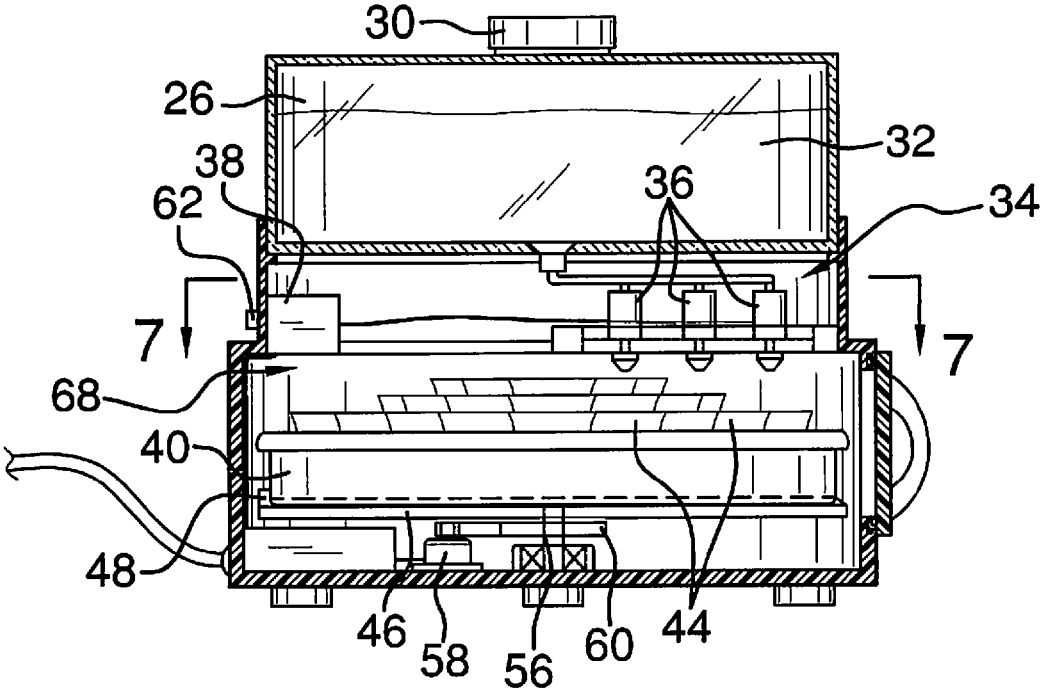
FIG. 6 is a cross-sectional view of an embodiment of the disclosure taken along line 6-6 of FIG. 3.
Figure 7:
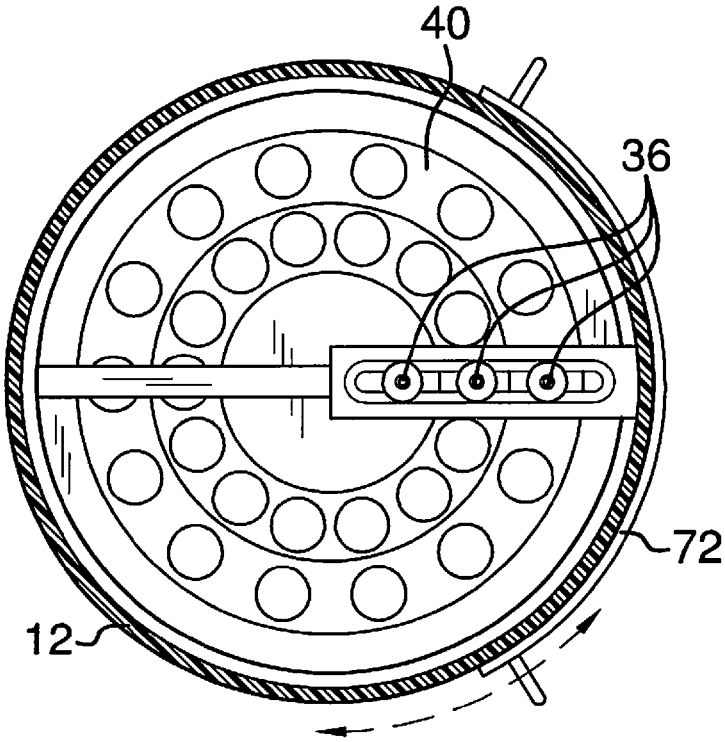
FIG. 7 is a cross-sectional view of an embodiment of the disclosure taken along line 7-7 of FIG. 6.
Figure 8:
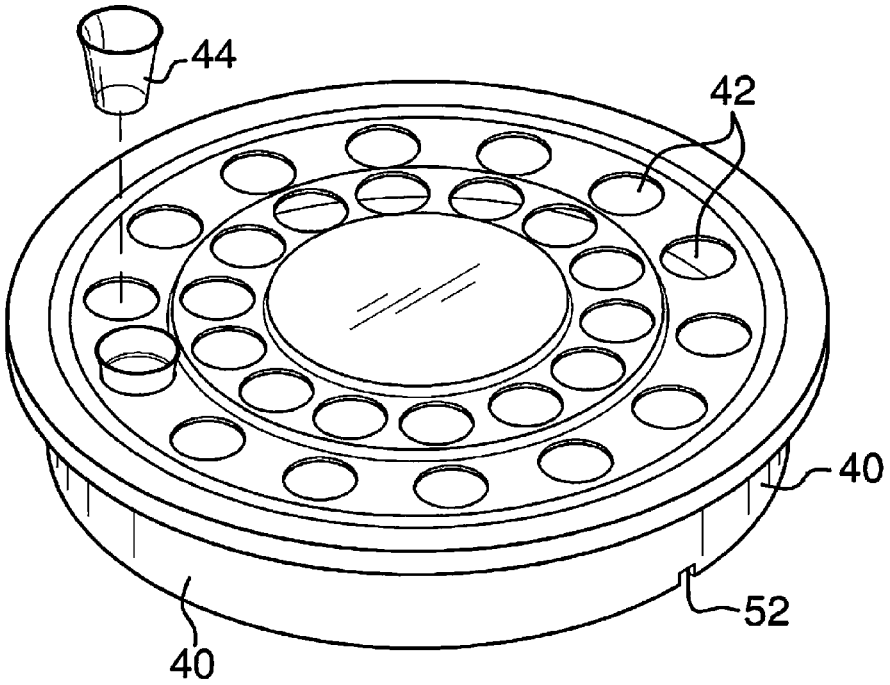
FIG. 8 is a top front side perspective view of a tray of an embodiment of the disclosure.
Figure 9:
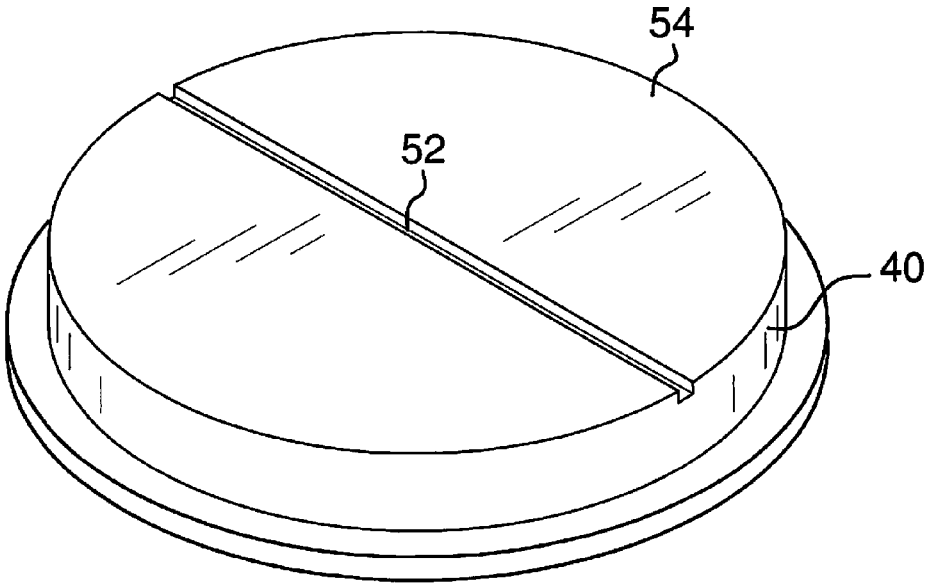
FIG. 9 is a bottom front side perspective view of a tray of an embodiment of the disclosure.
Figure 10:
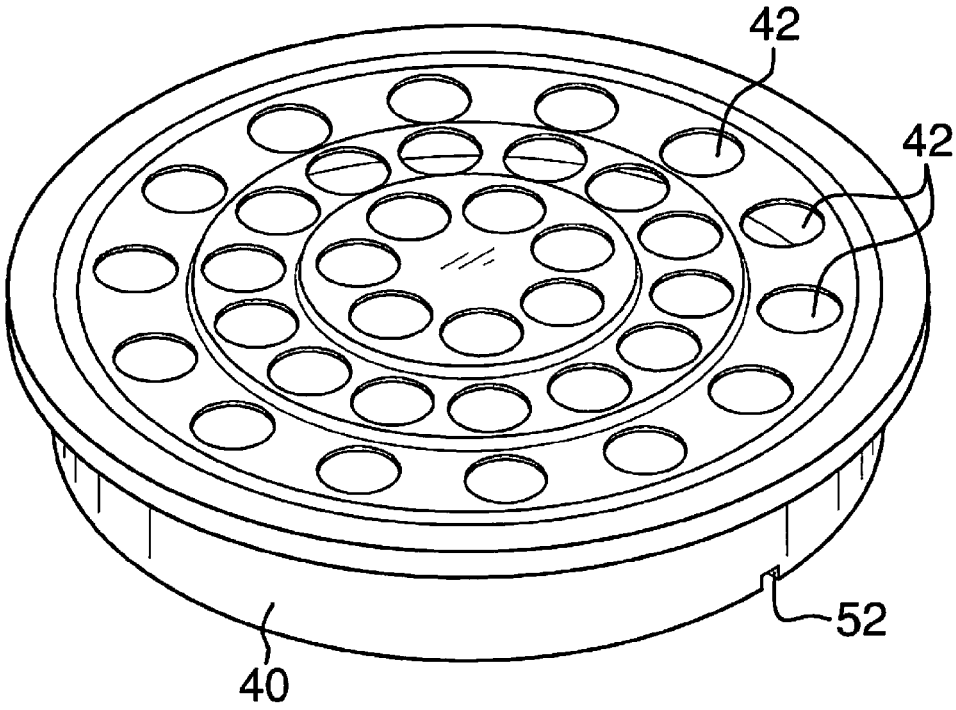
FIG. 10 is a top front side perspective view of a tray of an embodiment of the disclosure.

As best illustrated in FIGS. 1 through 10, the beverage tray filling assembly 10 generally comprises a housing 12 having a bottom 14 and a perimeter wall 16 extending upwardly from the bottom 14 of the housing 12. The perimeter wall 16 defines a base 18 of the housing 12. The housing 12 may also have a peripheral wall 20 coupled to and extending upwardly from the perimeter wall 16. The peripheral wall 20 is inwardly offset from the perimeter wall 16 defining an upper section 22 of the housing 12. The base 18 may have a rectangular shape, as seen in FIG. 2, or circular shape, as seen in FIG. 1.

An access opening 24 extends through the perimeter wall 16 of the housing 12. A tank 26 is coupled to the housing 12 and may be placed on top of the housing 12. The tank 26 may have a wide mouthed hole 28 coverable by a cap 30. The tank 26 is configured for holding a beverage 32 such as juice or wine to be distributed to a congregation for a communion ceremony. A filling assembly 34 is coupled to and positioned in the housing 12. The filling assembly 34 is in fluid communication with the tank 26. Thus, the filling assembly 34 is configured for dispensing the beverage 32 from the tank 26. The filling assembly 34 may have a plurality of aligned nozzles 36. The nozzles 36 are each configured for dispensing the beverage 32. The filling assembly 34 may be positioned in the upper section 22 of the housing 12. The filling assembly 34 may include a processor 38 operationally coupled to the nozzles 36 for selectively opening each nozzle 36 independently.

A tray 40 is insertable through the access opening 24 and positionable in the base 18 of the housing 12. The tray 40 has a plurality of apertures 42. The apertures 42 in the tray 40 may be radially aligned whereby the apertures 42 are selectively alignable with the nozzles 36. A plurality of serving cups 44 is provided. Each serving cup 44 is positioned in an associated one of the apertures 42 in the tray 40. The tray 40 is positionable whereby each serving cup 44 is configured to receive the beverage 32 dispensed from the tank 26 by the filling assembly 34. The processor 38 may be pre-programmed to open the nozzles 36 corresponding to a predetermined pattern corresponding to the positioning of the apertures 42 and serving cups 44 in the event there are fewer rows of apertures 42 than nozzles 36 of if the apertures 42 are not radially aligned.

A rotating panel 46 is coupled to and positioned in the base 18. The tray 40 is positionable on the rotating panel 46 whereby the tray 40 is rotated to align the nozzles 36 with the serving cups 46 in the apertures 42. To insure proper alignment, a tongue 48 may extend upwardly from a top surface 50 of the rotating panel 46 and a groove 52 may extend into a bottom 54 of the tray 40. The groove 52 receives the tongue 48 when the tray 40 is positioned on the rotating panel 46. Thus, the tray 40 is held in a static position relative to the rotating panel 46 as the rotating panel 46 rotates. Further, the orientation of the groove 52 may be consistent or known relative to the apertures 42 thus facilitating proper alignment of the nozzles 36 and serving cups 44 by a program implemented by the processor 38. A shaft 56 is coupled to and extends from the rotating panel 46. A motor 58 is coupled to and positioned in the housing 12. The motor 58 is operationally coupled to the shaft 56 by a belt 60 or gearing whereby the motor 58 selectively rotates the rotating panel 46. The motor 58 may be operationally controlled by the processor 38.

A dispensing button 62 is coupled to the housing 12. Indicator lights 64 may also be coupled to the housing 12 to indicate progress while filling the serving cups 44 with the beverage 32. The dispensing button 62 is operationally coupled to the filling assembly 34 and the motor 58 for selectively rotating the tray 40 and dispensing the beverage 32 into each of the serving cups 44 when the serving cup 44 is positioned beneath one of the nozzles 36.

A door 72 may be coupled to the housing 12. The door 72 selectively covers the access opening 24. The door 72 may be slidably coupled to the perimeter wall 16 to slide between an open position 66 providing access to an interior 68 of the base 18 through the access opening 24 and a closed positioned 70 blocking the access opening 24.

In use, the tray 40 is inserted through the access opening 24 and placed on the rotating panel 46. The dispensing button 62 is manipulated to initiate filling of the serving cups 44 in the apertures 42 in the tray 40. When all the serving cups 44 have been filled with the beverage 32, the door 72 is opened and another tray 40 may be loaded into the base 12 for filling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A beverage tray filling assembly comprising:

a housing having a bottom and a perimeter wall extending upwardly from said bottom of said housing, said perimeter wall defining a base of said housing;

an access opening extending through said perimeter wall of said housing;

a tank, said tank being coupled to said housing, said tank being configured for holding a beverage;

a filling assembly coupled to and being positioned in said housing, said filling assembly being in fluid communication with said tank whereby said filling assembly is configured for dispensing the beverage from said tank, said filling assembly having a plurality of aligned nozzles;

a tray being insertable through said access opening and positionable in said base of said housing, said tray having a plurality of apertures, said apertures in said tray being radially aligned whereby said apertures are selectively alignable with said nozzles for filling said serving cups;

a plurality of serving cups, each serving cup being positioned in an associated one of said apertures in said tray, said tray being positionable whereby each serving cup is configured to receive the beverage dispensed from said tank by said filling assembly;

a rotating panel coupled to and positioned in said base, said tray being positionable on said rotating panel whereby said tray is rotated to align said nozzles with said serving cups in said apertures;

a tongue extending upwardly from a top surface of said rotating panel;

a single groove extending into and fully across a bottom of said tray, said groove receiving said tongue when said tray is positioned on said rotating panel whereby said tray is held in a static position relative to said rotating panel as said rotating panel rotates and wherein said apertures in said tray are consistently positioned relative to said rotating panel when said tray is positioned on said rotating panel; and a processor configured to control opening of the nozzles and positioning of the rotating panel;

wherein the number of nozzles is fewer than the number of apertures in the tray, and the processor controls positioning of the rotating panel during filling based on a known position of the tongue to align the serving cups with the nozzles in a plurality of rotational positions of the rotating panel.

2. The assembly of claim 1, further including said housing having a peripheral wall coupled to and extending upwardly from said perimeter wall, said peripheral wall being inwardly offset from said perimeter wall, said peripheral wall defining an upper section of said housing.

3. The assembly of claim 2, further including said filling assembly being positioned in said upper section of said housing.

4. The assembly of claim 1, further comprising:

a shaft coupled to and extending from said rotating panel; and a motor coupled to and positioned in said housing, said motor being operationally coupled to said shaft whereby said motor selectively rotates said rotating panel.

5. The assembly of claim 4, further including a dispensing button coupled to said housing, said dispensing button being operationally coupled to said filling assembly and said motor for selectively rotating said tray and dispensing said beverage into each of said serving cups when said serving cup is positioned beneath one of said nozzles.

6. The assembly of claim 1, further including a dispensing button coupled to said housing, said dispensing button being operationally coupled to said filling assembly.

7. The assembly of claim 1, further including a door coupled to said housing, said door selectively covering said access opening.

8. The assembly of claim 7, further including said door being slidably coupled to said perimeter wall, said door being slidable between an open position providing access to an interior of said base through said access opening and a closed positioned blocking said access opening.

9. A beverage tray filling assembly comprising:

a housing having a bottom and a perimeter wall extending upwardly from said bottom of said housing, said perimeter wall defining a base of said housing, said housing having a peripheral wall coupled to and extending upwardly from said perimeter wall, said peripheral wall being inwardly offset from said perimeter wall, said peripheral wall defining an upper section of said housing;

an access opening extending through said perimeter wall of said housing;

a tank, said tank being coupled to said housing, said tank being configured for holding a beverage;

a filling assembly coupled to and being positioned in said housing, said filling assembly being in fluid communication with said tank whereby said filling assembly is configured for dispensing the beverage from said tank, said filling assembly having a plurality of aligned nozzles, said nozzles being configured for dispensing the beverage, said filling assembly being positioned in said upper section of said housing;

a tray being insertable through said access opening and positionable in said base of said housing, said tray having a plurality of apertures, said apertures in said tray being radially aligned whereby said apertures are selectively alignable with said nozzles;

a plurality of serving cups, each serving cup being positioned in an associated one of said apertures in said tray, said tray being positionable whereby each serving cup is configured to receive the beverage dispensed from said tank by said filling assembly;

a rotating panel coupled to and positioned in said base, said tray being positionable on said rotating panel whereby said tray is rotated to align said nozzles with said serving cups in said apertures;

a tongue extending upwardly from a top surface of said rotating panel;

a single groove extending into a bottom of said tray, said groove receiving said tongue when said tray is positioned on said rotating panel whereby said tray is held in a static position relative to said rotating panel as said rotating panel rotates and wherein said apertures in said tray are consistently positioned relative to said rotating panel when said tray is positioned on said rotating panel;

a shaft coupled to and extending from said rotating panel;

a motor coupled to and positioned in said housing, said motor being operationally coupled to said shaft whereby said motor selectively rotates said rotating panel;

a dispensing button coupled to said housing, said dispensing button being operationally coupled to said filling assembly and said motor for selectively rotating said tray and dispensing said beverage into each of said serving cups when said serving cup is positioned beneath one of said nozzles;

a door coupled to said housing, said door selectively covering said access opening, said door being slidably coupled to said perimeter wall, said door being slidable between an open position providing access to an interior of said base through said access opening and a closed positioned blocking said access opening; and a processor configured to control opening of the nozzles and positioning of the rotating panel;

wherein the number of nozzles is fewer than the number of apertures in the tray, and the processor controls positioning of the rotating panel during filling based on a known position of the tongue to align the serving cups with the nozzles in a plurality of rotational positions of the rotating panel.

* * * * *